US005282996A

United States Patent [19]

Appel et al.

[11] Patent Number: 5,282,996

[45] Date of Patent: Feb. 1, 1994

[54] DETERGENT COMPOSITIONS AND PROCESS FOR PREPARING THEM

[75] Inventors: Peter W. Appel, Rotterdam; Lucas D. M. Van Den Brekel, Berkel en Rodenrijs; Pieter A. Pel, Delft; Petrus L. J. Swinkels, Voerendaal, all of Netherlands

[73] Assignee: Lever Brothers Company, Division of Conopco, Inc., New York, N.Y.

[21] Appl. No.: 859,173

[22] Filed: Mar. 27, 1992

[30] Foreign Application Priority Data

Mar. 28, 1991 [EP] European Pat. Off. ..... 91200740.8

[51] Int. Cl.[5] ..... C11D 11/04

[52] U.S. Cl. ..... 252/100; 252/174.14; 252/531; 252/550; 252/551

[58] Field of Search ..... 252/531, 550, 554, 558, 252/539, 174.14, 100

[56] References Cited

U.S. PATENT DOCUMENTS

| | | | |
|---|---|---|---|
| 3,472,784 | 10/1969 | Poe | 252/531 |
| 3,957,671 | 5/1976 | Sagel et al. | 252/555 |
| 4,734,224 | 3/1988 | Barrett et al. | 252/558 |
| 5,160,657 | 11/1992 | Bortolotti et al. | 252/174.14 |
| 5,164,108 | 11/1992 | Appel et al. | 252/174.14 |

FOREIGN PATENT DOCUMENTS

| | | |
|---|---|---|
| 0342043 | 11/1989 | European Pat. Off. . |
| 0352135 | 1/1990 | European Pat. Off. . |
| 0388705 | 9/1990 | European Pat. Off. . |
| 0420317 | 4/1991 | European Pat. Off. . |
| 2166452 | 5/1986 | United Kingdom . |
| 2221695 | 2/1990 | United Kingdom . |

OTHER PUBLICATIONS

"Highly Concentrated Powder Detergents", Kao Corp. Chemical Abstracts vol. 103, No. 12, Sep. 1985, Abstract No. 89343.

*Primary Examiner*—Olik Chaudhuri
*Assistant Examiner*—C. Everhart
*Attorney, Agent, or Firm*—James J. Farrell

[57] ABSTRACT

A single-step process for the continuous preparation of a granular detergent composition or component, whereby 20 to 45% of a liquid acid precursor of an anionic surfactant, and at least an equivalent amount of a solid water-soluble alkaline inorganic material are continuously fed into a high-speed mixer/densifier, the mean residence time being from about 5 to 30 seconds, whereby the moisture content of the powder in the mixer is from 5 to 15%, and a degree of neutralization of at least 80% is attained.

9 Claims, No Drawings

DETERGENT COMPOSITIONS AND PROCESS FOR PREPARING THEM

TECHNICAL FIELD

The present invention relates to detergent compositions and a process for preparing them. More in particular, it relates to a process for the continuous preparation of a granular detergent composition or component involving the neutralization of a liquid acid precursor of an anionic surfactant, and to the product thereby obtained

BACKGROUND AND PRIOR ART

Recently there has been considerable interest within the detergents industry in the production of detergent powders by means of processes involving the neutralization of a liquid acid precursor of an anionic surfactant with a solid water-soluble alkaline inorganic material, for example sodium carbonate. Such processes are sometimes referred to as in-situ neutralization processes. They have the advantage that by means of such processes detergent powders may be prepared without the use of a spray-drying tower, whereby substantial savings on capital and energy costs can be achieved.

Various in-situ neutralization processes have been described in the art. For example, GB-A-2 166 452 (Kao) discloses a process whereby an alkyl sulphonic acid, sodium carbonate and water are mixed in a strongly shearing apparatus to form a solid mass which is subsequently cooled and pulverized. The obtained powder is then granulated in a separate processing step.

GB-A-2 221 695 (Unilever) discloses a batch process for preparing a high bulk density detergent powder whereby a detergent acid is gradually added over a period of several minutes to a solid water-soluble inorganic material in a Fukae-mixer. Subsequently, the product is granulated in the presence of a liquid binder.

EP-A-342 043 (Procter and Gamble) discloses a process for preparing a detergent component whereby zeolite, sodium carbonate and linear benzene sulphonic acid are fed continuously into a high intensity Lödige mixer. The contact time is said to be relatively short in comparison to the reaction time required for complete neutralization of the acid, and therefore the powder is placed subsequently in a batch mixer and provided with gentle agitation for 5 more minutes.

The above in-situ neutralization processes have the disadvantage that they involve several processing steps in order to arrive at a granular detergent compound, and that the time required to obtain neutralization of the acid anionic surfactant precursor is in the order of several minutes.

It is an object of the present invention to provide a simple and effective continuous in-situ neutralization process for preparing a granular detergent component or compound, in particular having a high level of anionic surfactant.

We have now surprisingly found that by means of the essentially single-step process of the invention a granular detergent compound or component may be prepared in continuous way whereby a degree of neutralization of at least 80% can be achieved, provided that the particle moisture content is maintained at values between 5 and 15%.

DEFINITION OF THE INVENTION

In a first aspect, the present invention accordingly provides a single-step process for the continuous preparation of a granular detergent composition or component, whereby 20 to 45% of a liquid acid precursor of an anionic surfactant, and at least an equivalent amount of a solid water-soluble alkaline inorganic material are continuously fed into a high-speed mixer/densifier, the mean residence time being from about 5 to 30 seconds, whereby the moisture content of the powder in the mixer is from 5 to 15%, and a degree of neutralization of at least 80% is attained. Preferably, the anionic surfactant is a primary alcohol sulphate.

In a second aspect, the invention provides a granular detergent composition or component prepared by this process.

DETAILED DESCRIPTION OF THE INVENTION

The present invention is concerned with the preparation of a detergent powder or detergent component by means of a continuous process which involves the in situ neutralization of the acid precursor of an anionic surfactant with an alkaline solid component. An important characteristic of the present process is that the detergent material remains throughout the process in particulate or granular form. Caking, balling and dough formation are avoided and the final product does not require any additional steps in which the particle size is reduced, or ageing steps to complete the neutralization reaction.

In the process of the invention, a solid water-soluble alkaline inorganic material is thoroughly mixed with a liquid acid precursor of an anionic surfactant, possibly in the presence of other materials. The acidic anionic surfactant precursor is thereby neutralized for at least 80% to form a salt of the anionic surfactant.

In principle, any solid water-soluble alkaline inorganic material can be used in the present process. The preferred material is sodium carbonate, alone or in combination with one or more other water-soluble inorganic materials, for example, sodium bicarbonate or silicate. Sodium carbonate can provide the necessary alkalinity for the wash process, but it can additionally serve as a detergency builder. The invention may be advantageously used for the preparation of detergent powders in which sodium carbonate is the sole or principal builder. In this case, substantially more carbonate will be present than required for the neutralization reaction with the acid anionic surfactant precursor.

In addition to the solid water-soluble alkaline inorganic material other materials may be fed into the process, for example compounds usually found in detergent compositions, such as (non-carbonate) builders, e.g. sodium tripolyphosphate or zeolite, surfactants, e.g. anionics or nonionics, all well known in the art. Other examples of materials which may be present include fluorescers; polycarboxylate polymers; anti-redeposition agents, such as carboxy methyl cellulose; fatty acids; fillers, such as sodium sulphate; diatomaceous earth; calcite; clays, e.g. kaolin or bentonite.

These materials for use in the process of the invention may be prepared by any suitable method, such as spray-drying, dry-mixing or granulation. It may also be desirable that one or more of these materials are adjuncts of liquids onto solid components, prepared by spray-drying, granulation or via in-situ neutralization in a high-speed mixer.

The process of the invention is very suitable for preparing detergent powders or components having widely different chemical compositions. Phosphate containing as well as zeolite containing compositions may be prepared. The process is also suitable for preparing calcite/carbonate containing detergent components or compositions. The final detergent product may for example comprise 20 to 50 wt% of a builder, 5 to 70 wt% carbonate, 20 to 45 wt% anionic surfactant, 0 to 20 wt% nonionic surfactant and 0 to 5 wt% soap.

The liquid acid precursor of an anionic surfactant may be selected from the acid precursors of linear alkyl benzene sulphonate, alpha-olefin sulphonate, internal olefin sulphonate, alkyl ether sulphate or fatty acid ether sulphate and combinations thereof. The process of the invention is very useful for producing compositions comprising alkyl benzene sulphonates by reaction of the corresponding alkyl benzene sulphonic acid, for instance Dobanoic acid ex Shell.

An especially preferred class of anionic surfactants are primary or secondary alcohol sulphates. Linear or branched primary alcohol sulphates having 10 to 20 carbon atoms are particularly preferred. These surfactants can be obtained by sulphatation of the corresponding primary or secondary alcohols, from synthetic or natural origin, followed by neutralization. Because the acid precursors of alcohol sulphates are chemically unstable, they are not commercially available and they have to be neutralized as quickly as possible after their manufacture. The process of the present invention is especially suitable for incorporating alcohol sulphate surfactants into detergent powders because it involves a very efficient mixing step wherein the acid surfactant precursor and the solid alkaline substance are brought into contact with one another. In this step a quick and efficient neutralization reaction is effected whereby the decomposition of the alcohol sulphate acid is successfully kept at a minimum.

In the process of the invention, the solid materials are very thoroughly mixed with the liquid components by means of a high-speed mixer/densifier. Such a mixer provides a high energy stirring input and achieves thorough mixing in a very short time.

As high-speed mixer/densifier we advantageously used the Lödige (Trade Mark) CB 30 Recycler. This apparatus essentially consists of a large, static hollow cylinder having a diameter of about 30 cm which is horizontally placed. In the middle, it has a rotating shaft with several different types of blades mounted thereon. It can be rotated at speeds between 100 and 2500 rpm, dependent on the mixing intensity and particle size desired. The blades on the shaft provide a thorough mixing action of the solids and the liquids which may be admixed in the apparatus. The mean residence time is somewhat dependent on the rotational speed of the shaft, the position of the blades and the weir at the exit opening. In the process, the solid and liquid materials are thoroughly mixed in a high-speed mixer/densifier for a relatively short time of about 5 to 30 seconds. Preferably the mean residence time lies between about 8 and 20 seconds.

Other types of high-speed mixers/densifiers having a comparable effect on detergent powders can also be contemplated. For instance, a Shugi (Trade Mark) Granulator or a Drais (Trade Mark) K-TTP 80 may be used.

In the high-speed mixer/densifier the liquid acid precursor of the anionic surfactant is added. It is almost instantly mixed with the alkaline inorganic water-soluble material and the neutralization reaction begins. The powder moisture content was found to be very important for the reaction speed. The term "powder moisture content" is used herein to indicate water that is released after storage in an oven for 4 hours at 135° C. If the powder moisture content is below 5%, the neutralization reaction will proceed slowly or not at all and the reaction mixture leaving the high-speed mixer/ densifier will still contain substantial amounts of unreacted acid precursor of the anionic surfactant, in the order of 20% or more. This may cause agglomeration of the powder or even dough formation and, in the case of alcohol sulphates, may lead to decompositions of the anionic surfactant.

The solid starting materials may already contain sufficient moisture for these conditions to be attained. For example, a spray-dried detergent base powder blown to a relatively high water content could provide all the moisture required. If insufficient moisture is present, a carefully controlled amount of water should be added in the high-speed mixer/ densifier, either admixed with the acid precursor or sprayed on separately.

Consequently, a small amount of moisture should be present, just sufficient to initiate the neutralization reaction, but less than 15% to prevent substantial agglomeration. We have found that provided these limits for the powder moisture contents are observed, the neutralization reaction will proceed efficiently to values of more than 80%, or even more than 90%, in the relatively short period of 5 to 30 seconds.

The degree of neutralization can be measured by determining the remaining amount of acid surfactant precursor in the powder leaving the high-speed mixer/-densifier. Because the neutralization reaction may still proceed after a sample of the powder has been taken, it is essential for a reliable measurement to stop the reaction instantly. This can be achieved by submerging the sample in liquid nitrogen. The sample is then reacted with a methylating reagent, suitably methyl tolyl triazene (MTT) using chloroform as solvent. Subsequently, the amount of methylated free acid can be determined by conventional $^1$H-NMR techniques.

Apart from the liquid acid precursor of the anionic surfactant, other liquid components may also be introduced in the high-speed mixer/densifier. Examples of such ingredients include nonionic surfactants and low-melting fatty acids which may also be neutralized by the solid alkaline inorganic material to form soaps. It is also possible to add aqueous solutions of detergent components, such as fluorescers, polymers, etc., provided that the total amount of free water is kept within the desired range.

The invention will now be further illustrated by the following non-limiting Examples in which parts and percentages are by weight unless otherwise indicated.

In the Examples, the following abbreviations are used for the employed materials:

| | |
|---|---|
| ABS | Alkyl benzene sulphonic acid, Dobanoic acid, ex Shell |
| PAS | Primary alcohol sulphate (acid), obtained by sulphatation of Lial 125, a $C_{12}$–$C_{15}$ primary alcohol mixture ex Enichem |
| CocoPAS | Primary alcohol sulphate (acid), obtained by sulphatation of coco-alcohol, NAFOL 1218 K |

-continued

| | |
|---|---|
| | ex Condea |
| Nonionic | Nonionic surfactant (ethoxylated alcohol), Synperonic A7 ex ICI (7EO groups) |
| Copolymer | Copolymer of maleic and acrylic acid, sold by BASF under the trade-name Sokalan CP5 |
| Carbonate | Sodium carbonate |
| Silicate | Sodium alkaline silicate |
| Zeolite | Zeolite A4 (Wessalith [Trade Mark] ex Degussa) |
| Calcite | Calcium carbonate, Socal U3, ex Solvay |

EXAMPLES 1-5

The following solid detergent ingredients were continuously fed into a Lödige (Trade Mark) Recycler CB30, a continuous high speed mixer/densifier, which was described above in more detail. The amounts are given as parts.

TABLE 1

| Example | 1 | 2 | 3 | 4 | 5 |
|---|---|---|---|---|---|
| Zeolite (78%) | 30.0 | 75.0 | 52.0 | 52.0 | 52.0 |
| Carbonate | 66.0 | 35.0 | 32.0 | 42.0 | 24.0 |

The zeolite was added in the form of a powder containing 78% by weight pure zeolite, the remainder being water. The following liquids were also continuously added in the Recycler, as indicated in Table 2.

TABLE 2

| Example | 1 | 2 | 3 | 4 | 5 |
|---|---|---|---|---|---|
| ABS | 27.0 | — | — | — | — |
| PAS | — | 40.0 | — | — | — |
| CocoPAS | — | — | 35.0 | 40.0 | 28.0 |
| Nonionic.7EO | — | — | — | — | 2.6 |
| Copolymer (40%) | — | — | — | — | 2.9 |
| Silicate (45%) | — | — | — | — | 10.5 |
| Water | 6.0 | 5.0 | 3.0 | 6.0 | — |
| Total | 129.0 | 155.0 | 122.0 | 140.0 | 120.0 |

The primary alcohol sulphate liquid anionic surfactant precursor (PAS) was prepared by direct sulphatation of the corresponding primary alcohol in a falling film type sulphatation reactor, of the sort used for sulphonation of alkyl benzenes. The PAS was then fed directly into the process. The polymer and the silicate were added as aqueous solutions of 40% and 45% by weight, respectively. The rotational speed of the Lödige Recycler was 1890 rpm. Powders were produced at a rate of between 1100 and 1600 kg/h; the mean residence time of the powder in the Lödige Recycler was approximately 10 seconds. Further details of the processing conditions and the properties of the powder after leaving the Lödige Recycler are given in Table 3.

TABLE 3

| Example | 1 | 2 | 3 | 4 | 5 |
|---|---|---|---|---|---|
| Bulk density [kg/m$^3$] | 613 | 650 | 591 | 626 | 661 |
| Moisture content [%] | 8.4 | 10.3 | 8.8 | 10.5 | 12.5 |
| Particle size [μm] | 541 | 711 | 749 | 1002 | 478 |
| Dynamic Flow Rate [ml/s] | 50 | 113 | 125 | 129 | 117 |
| Unconfined Compressibility Test [kg] | 3.0 | 0.05 | n.d. | n.d. | n.d. |
| Degree of Neutralization | 98% | 85% | 94% | 98% | 99% |

The chemical compositions of the resulting detergent powders are given in Table 4 in wt%. The amounts relate to the pure compounds.

TABLE 4

| | Powder composition: | | | | |
|---|---|---|---|---|---|
| Example | 1 | 2 | 3 | 4 | 5 |
| Zeolite | 18.7 | 39.0 | 34.3 | 29.6 | 35.1 |
| Carbonate | 48.0 | 18.0 | 21.0 | 26.0 | 16.0 |
| Sodium ABS | 23.0 | — | — | — | — |
| Sodium PAS | — | 29.0 | — | — | — |
| Sodium CocoPAS | — | — | 32.0 | 32.0 | 25.5 |
| Nonionic.7EO | — | — | — | — | 2.0 |
| Copolymer | — | — | — | — | 1.0 |
| Silicate | — | — | — | — | 4.0 |
| Water | 10.3 | 14.0 | 12.7 | 12.4 | 16.4 |
| Total | 100.0 | 100.0 | 100.0 | 100.0 | 100.0 |

EXAMPLES 6,7

The following solid detergent ingredients were continuously fed into the same Lödige Recycler as applied for examples 1-5. The amounts are given as parts.

TABLE 5

| Example | 6 | 7 |
|---|---|---|
| Calcite | 26.0 | 21.0 |
| Carbonate | 30.0 | 20.0 |

The following liquids were also continuously added in the Recycler, as indicated in Table 6.

TABLE 6

| Example | 6 | 7 |
|---|---|---|
| ABS | 36.0 | 28.0 |
| water | 3.0 | 6.0 |
| Total | 95.0 | 75.0 |

The rotational speed of the Lödige Recycler was 1890 rpm. Powders were produced at a rate of between 1100 an 1600 kg/h; the mean residence time of the powder in the Lödige Recycler was approximately 10 seconds. Further details of the processing conditions and the properties of the powder after leaving the Lödige Recycler are given in Table 7.

TABLE 7

| Example | 6 | 7 |
|---|---|---|
| Bulk density [kg/m$^3$] | 644 | 593 |
| Moisture content [%] | 5.1 | 9.1 |
| Particle size [μm] | 593 | 578 |
| Dynamic Flow Rate [ml/s] | 117 | 140 |
| Degree of Neutralization | 95% | 97% |

The chemical compositions of the resulting detergent powders are given in Table 8 in wt%.

TABLE 8

| | Powder composition | |
|---|---|---|
| Example | 6 | 7 |
| Calcite | 27.5 | 28.7 |
| Carbonate | 28.2 | 22.7 |
| Sodium ABS | 39.2 | 39.5 |
| Water | 5.1 | 9.1 |
| Total | 100.0 | 100.0 |

When comparing the powder compositions and properties found in the Examples 6 and 7 with those obtained in Examples 1-5 (as shown in Tables 3 and 4), it can be concluded that in both cases powders with good powder properties and a high degree of neutralization were obtained but also that powders with a higher actives level were obtained when using a calcite/carbonate builder system.

We claim:

1. A process for the continuous preparation of a granular detergent composition or component, said process comprising the steps of:

(i) continuously feeding 20 to 45% by weight of a liquid acid precursor of an anionic surfactant, and at least an equivalent amount of a solid water-soluble alkaline inorganic material capable of at least partially neutralizing said precursor into a high-speed mixer/densifier; and (ii) thoroughly mixing said liquid acid precursor and said solid alkaline material in the mixer/densifier to form a powder, the mean residence time being from about 5 to 30 seconds, whereby the moisture content of said powder is from 5 to 15% by weight, and a degree of neutralization of the liquid acid precursor of at least 80% is attained.

2. Process according to claim 1, whereby the anionic surfactant is a primary alcohol sulphate.

3. Process according to claim 1, wherein a degree of neutralization of more than 90% is attained.

4. Process according to claim 1, wherein the solid water-soluble alkaline inorganic material comprises sodium carbonate.

5. Process according to claim 1, whereby the moisture content of the powder in the mixer/densifier is from 8 to 12%.

6. Process according to claim 1, wherein 20 to 50% of one or more other materials are fed into the mixer/densifier, selected from the group consisting of builders and nonionic surfactants.

7. Process according to claim 1, wherein 20 to 50% of zeolite is fed into the mixer/densifier.

8. Process according to claim 1, wherein 20 to 50% of calcite is fed into the mixer/densifier.

9. Process according to claim 1, wherein the final product contains 25 to 45% anionic and/or nonionic surfactant.

* * * * *